US005957719A

United States Patent [19]

Okabe

[11] Patent Number: 5,957,719

[45] Date of Patent: Sep. 28, 1999

[54] PRESS-FITTING CONNECTOR ASSEMBLING STRUCTURE

[75] Inventor: Toshiaki Okabe, Shizuoka, Japan

[73] Assignee: Yazaki Corporation, Tokyo, Japan

[21] Appl. No.: 08/931,618

[22] Filed: Sep. 16, 1997

[30] Foreign Application Priority Data

Sep. 18, 1996 [JP] Japan ..... 8-246467

[51] Int. Cl.[6] ..... H01R 4/29

[52] U.S. Cl. ..... 439/404; 439/417; 439/701

[58] Field of Search ..... 439/404, 717, 439/405, 398, 460, 701, 417

[56] References Cited

U.S. PATENT DOCUMENTS 5,122,077 6/1992 Maejima et al. ..... 439/404
5,125,850 6/1992 Locati ..... 439/404

FOREIGN PATENT DOCUMENTS 55-92284 6/1980 Japan ..... H01R 13/436
58-13676 1/1983 Japan ..... H01R 13/436
4-15161 2/1992 Japan ..... H01R 4/24

*Primary Examiner*—Gary F. Paumen
*Assistant Examiner*—Alexander Gilman
*Attorney, Agent, or Firm*—Sughrue, Mion, Zinn, Macpeak & Seas, PLLC

[57] ABSTRACT

An assembling structure for assembling a press-fitting connector. In the assembling structure, first, a housing and a cover are assembled together by fitting a locking protrusion of a standing wall portion of the housing and a locking arm of the cover. Next, a coupling wall portion is coupled to the locking arm, a nipping wall portion is coupled to the coupling wall portion, and the standing wall portion is held between the locking arm and the nipping wall portion. Since the locking arm and the standing wall portion integrally follow deformation described below even if electric wire bending tension operates upon the electric wire and the housing and the cover are deformed, the degree of fitting between the locking protrusion and the locking arm is not decreased and the fitting is kept.

6 Claims, 6 Drawing Sheets

PRESS-FITTING CONNECTOR ASSEMBLING STRUCTURE

BACKGROUND OF THE INVENTION

1. Field of the Invention

The present invention relates to an assembling structure for assembling a press-fitting connector.

2. Description of the Related Art

FIG. 11 shows a conventional press-fitting connector disclosed in Japanese Utility Model Unexamined Publication No. Hei. 4-15161 and the conventional press-fitting connector has a housing 1 formed by insulating resin, an interlocked terminal 3 in which a plurality of press-fitting terminals 2 are interlocked, and a cover 4 formed of insulating resin attached to the housing 1 to cover the housing.

In the housing 1, a plurality of partition portions 6 are set up in parallel from a bottom wall portion 5, and a portion partitioned by the partition portions 6 functions as a terminal receiving chamber 7 for receiving each press-fitting terminal 2. Reference numeral 8 designates a terminal inserting hole open on the front face of the housing 1 for inserting an opposite terminal (not shown).

The interlocked terminal 3 is provided to integrate the plurality of press-fitting terminals 2 and insert them into the housing 1, and a coupling piece 3*a* coupling the press-fitting terminals 2 is cut off afterward.

Each press-fitting terminal 2 is provided with a cylindrical contact portion 9 which comes in contact with the corresponding opposite terminal for electrical contact when the opposite terminal is inserted, and a press-fitting portion 10 and a clamping portion 11 respectively joined to the contact portion 9 in order. The press-fitting portion 10 is formed in the shape of U, and the bent both ends function as press-fitting blades 12 which bite an electric wire 13. The press-fitting portion 10 comes in contact with a conductor 15 inside an insulating coating 14 for electrical contact when the press-fitting blades 12 bite the insulating coating 14 of the electric wire 13. The clamping portion 11 fixes the electric wire 13 by being clamped.

The cover 4 is put on the housing 1 so that the cover crosses the housing 1. A plurality of electric wire pressing protrusions 16 each of which enters each terminal receiving chamber 7 of the housing 1 are formed on the face of the cover 4 opposite to the housing 1. When each electric wire pressing protrusion 16 enters the corresponding terminal receiving chamber 7, the electric wire 13 is press-fitted to the press-fitting blades 12 of the press-fitting terminal 2 so that the electric wire 13 and the press-fitting terminal 2 are electrically connected to each other.

The cover 4 and the housing 1 are assembled by forming locking protrusions 18 respectively on the outside surfaces of standing wall portions 17 set up at the right and left ends of the housing 1 and forming locking arms 19 respectively at the right and left ends of the cover 4. In detail, a locking hole 19*a* is formed through each locking arm 19, and the locking protrusion 18 is fitted into the locking hole 19*a* of the locking arm 19 by covering the housing 1 with the cover 4 and pressing the cover down, so that the housing 1 and the cover 4 can be assembled.

However, in the assembling structure of the conventional press-fitting connector, the fitting of the locking protrusion 18 and the locking arm 19 is readily detached. FIG. 12 explains such a phenomenon, and if tension in the direction in which the electric wire 13 is bent operates on the electric wire, the standing wall portions 17 of the housing 1 and the locking arms 19 are deformed in that direction. The degree of the fitting of the locking protrusion 18 and the locking arm 19 is decreased because of the above deformation, and the locking protrusion 18 is detached from the locking hole 19*a*. When the fitting of the locking protrusion 18 and the locking arm 19 is released as described above, the press-fitting terminal 2 and the electric wire 13 are withdrawn from the terminal receiving chamber 7, to thereby make the electrical contact defective.

SUMMARY OF THE INVENTION

The present invention was made to solve such a problem of the conventional press-fitting connector, and an object is to provide an assembling structure of a press-fitting connector in which a locking protrusion and a locking arm are not detached from each other even if tension in the direction in which an electric wire is bent operates on the electric wire.

In order to achieve the above object, the present invention provides an assembling structure of a press-fitting connector, comprising: a first connecting member having partition portions forming a terminal receiving chamber and a standing wall portion on one surface of which a locking protrusion is formed; a second connecting member having a locking arm to be fitted to the locking protrusion and to be attached to the first connecting member; and a nipping wall portion coupled to the locking arm by a coupling wall portion so that the nipping wall portion is opposite to the other surface of the standing wall portion and for nipping the standing wall portion in cooperation with the locking arm.

DETAILED DESCRIPTION OF THE PREFERRED EMBODIMENTS

Figure 1:
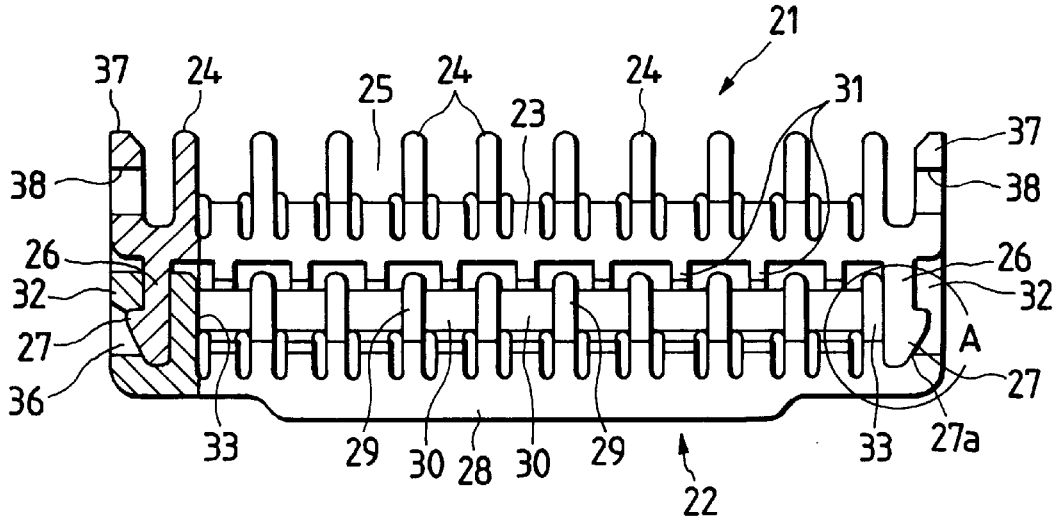
FIG. 1 is a partial front sectional view showing an embodiment of the present invention.
Figure 2:
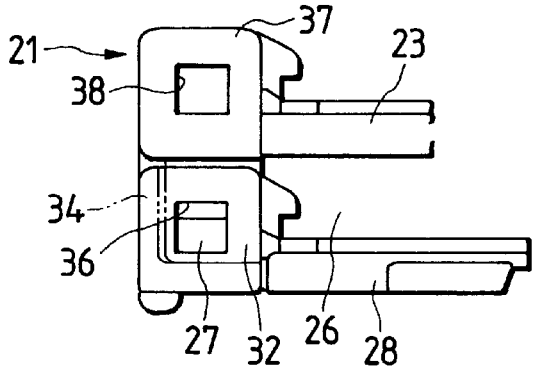
FIG. 2 is a right side view showing the embodiment.
Figure 3:
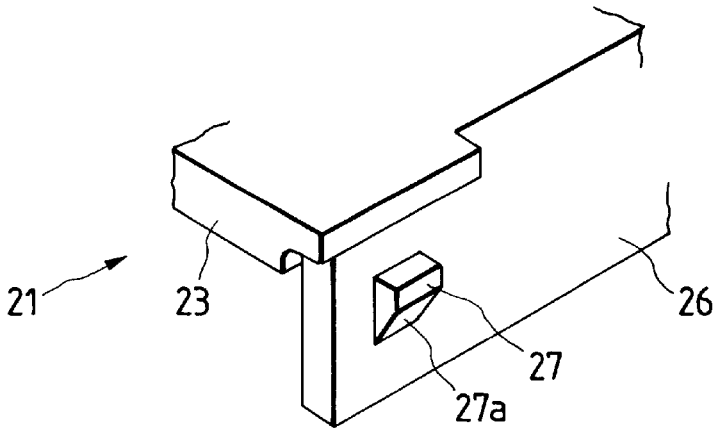
FIG. 3 is a partial perspective view showing a housing in the embodiment.
Figure 4:
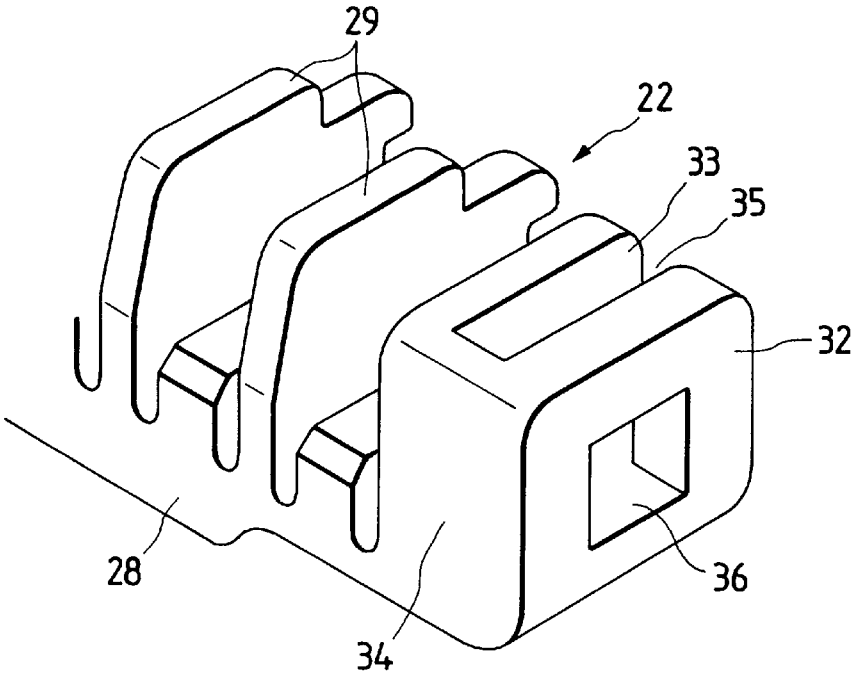
FIG. 4 is a partial perspective view showing a cover in the embodiment.
Figure 5:
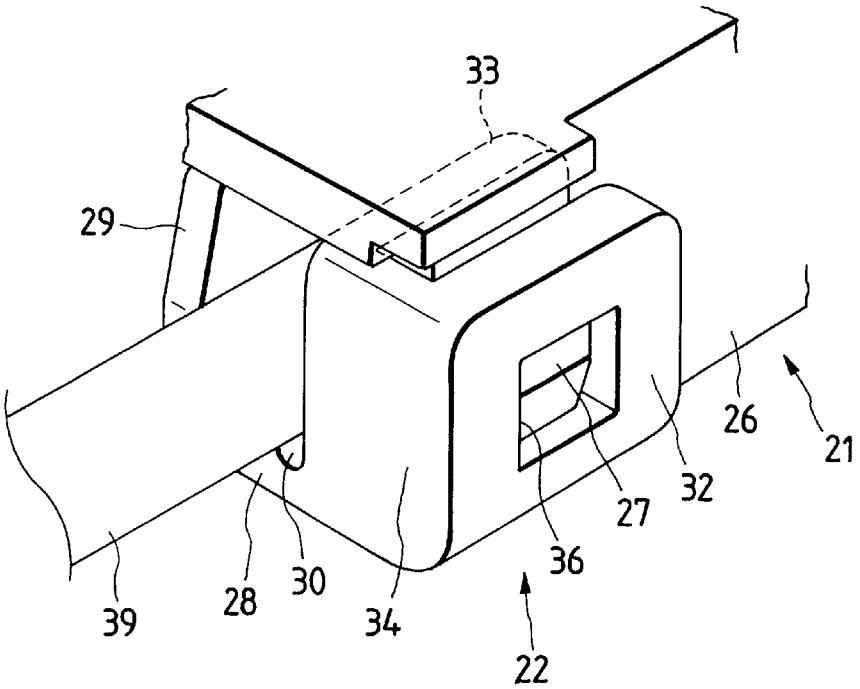
FIG. 5 is a perspective view in which a part A shown in FIG. 1 is enlarged for explaining the operation of the embodiment.

FIGS. 1 to 5 show an embodiment of the present invention, FIG. 1 is a partial front sectional view, FIG. 2 is a side view thereof, FIG. 3 is a partial perspective view showing a housing, FIG. 4 is a partial perspective view showing a cover, and FIG. 5 is a perspective view in which a part A shown in FIG. 1 is enlarged for explaining the operation. In this embodiment, the present invention is applied to the assembling structure of a housing 21 and a cover 22, and the housing 21 corresponds to a first connecting member while the cover 22 corresponds to a second connecting member.

Figure 11:
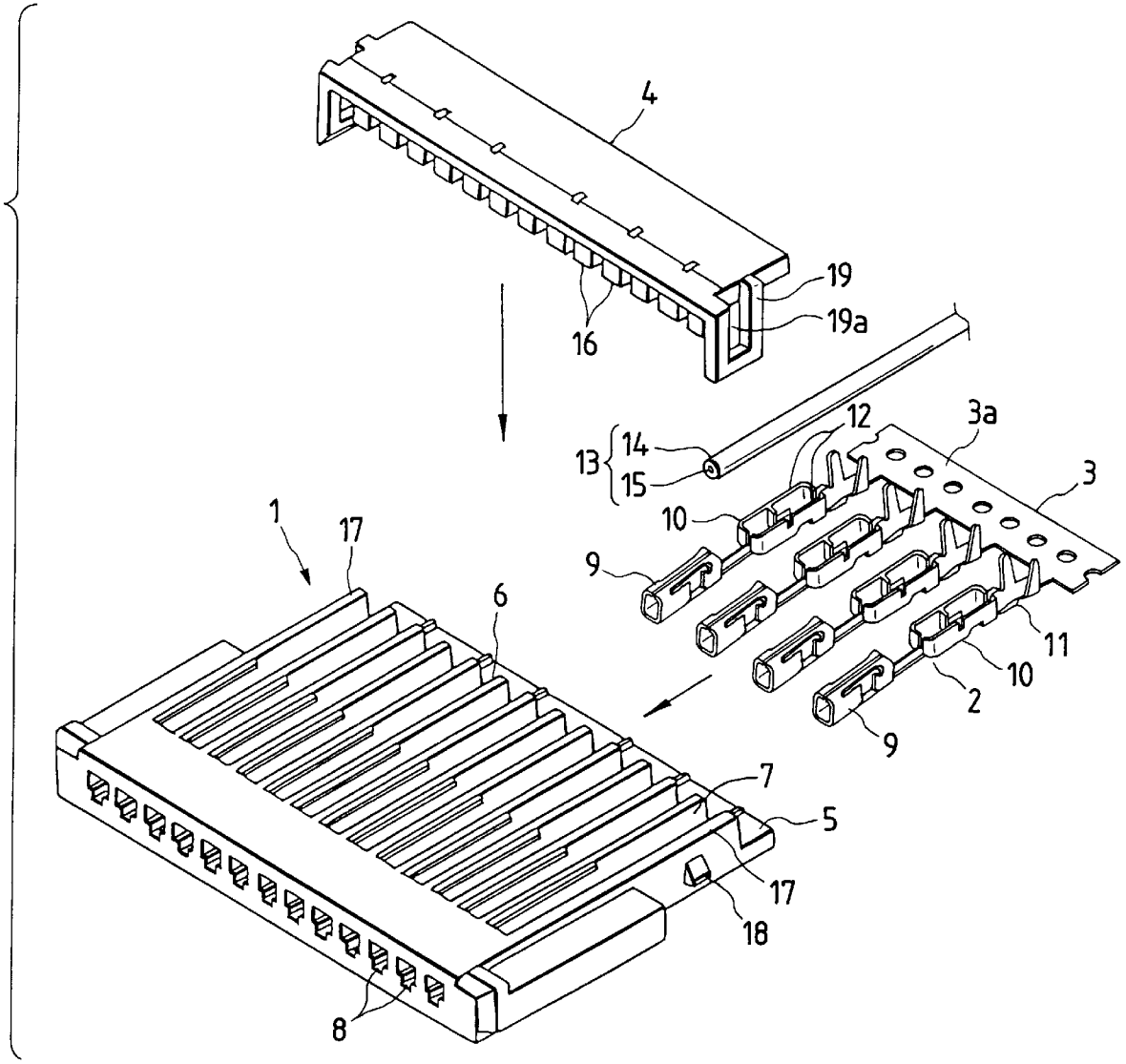
FIG. 11 PRIOR ART
FIG. 11 is an exploded perspective view showing a conventional press-fitting connector.
Figure 12:
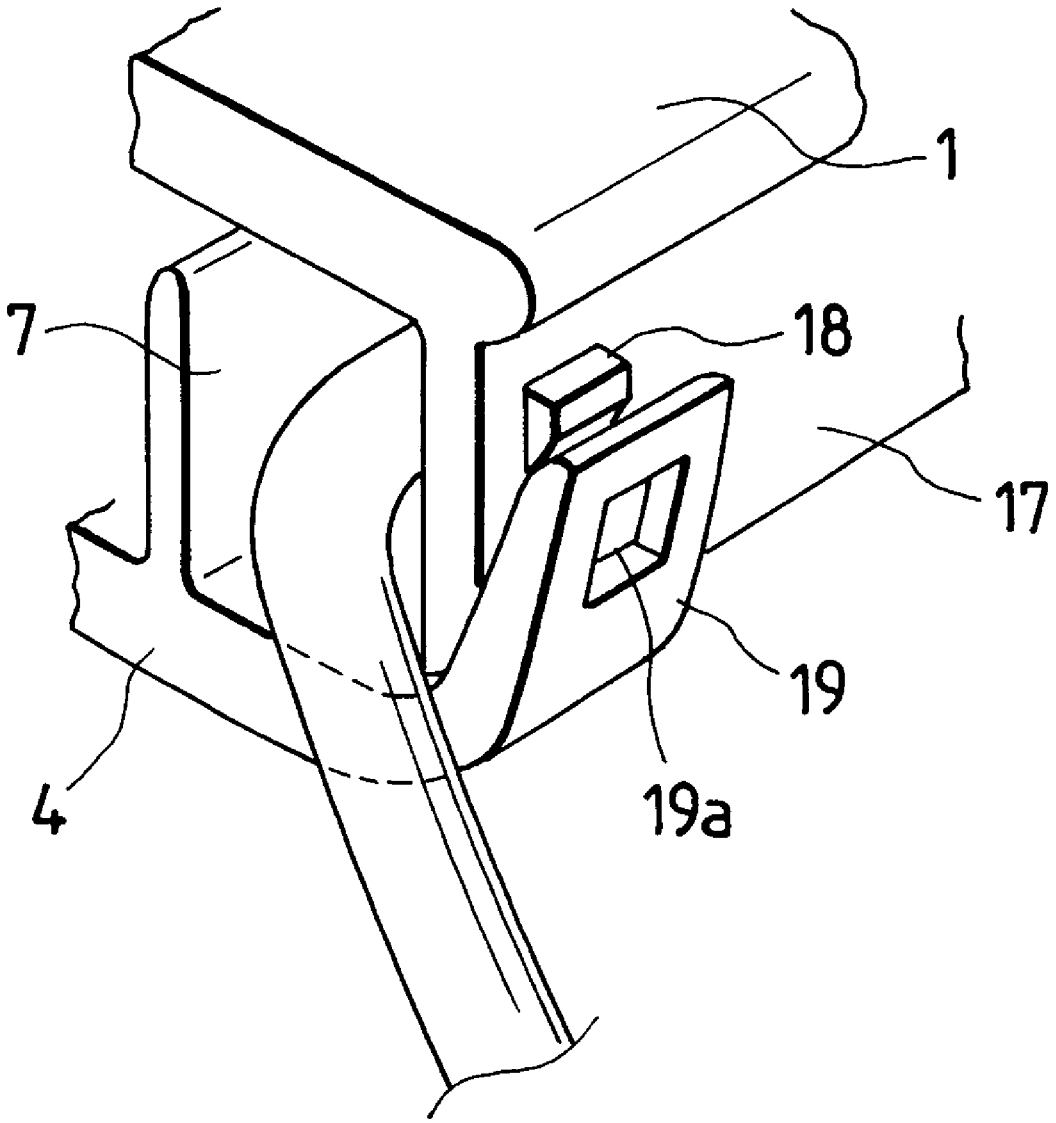
FIG. 12 PRIOR ART
FIG. 12 is a perspective view for explaining the problem of the conventional press-fitting connector.

The housing 21 as the first connecting member is formed by insulating resin in the shape shown in FIG. 1. That is, a plurality of partition portions 24 are set up in parallel from a bottom wall portion 23 extending in the direction perpendicular to the paper surface, and a portion partitioned by the partition portions 24 functions as a terminal receiving chamber 25 the upper surface of which is open so that each press-fitting terminal is received in each terminal receiving chamber 25. The press-fitting terminal 2 shown in FIG. 11 may be used for the press-fitting terminal in this embodiment, and therefore, the description thereof is omitted here.

Standing wall portions 26 integrally hanging from the bottom wall portion 23 are formed at the right and left ends of the housing 21. The standing wall portions 26 are provided so that they are located inside the both ends of the housing 21, and a locking protrusion 27 is formed on the outer surface of each standing wall portion 26. A tapered face 27*a* is formed in the lower portion of the locking protrusion 27 as shown in FIGS. 1 and 3, and the cover 22 can be readily fitted to the housing 21 from a lower position along the tapered face 27*a*.

The cover 22 as the second connecting member is formed by insulating resin, and as shown in FIG. 1, a plurality of partition portions 29 are set up in parallel from a bottom portion 28 so that each portion between the partition portions 29 functions as a terminal receiving chamber 30. An electric wire pressing protrusion 31 is formed, opposite to each terminal receiving chamber 30 formed in the cover 22, from the bottom wall portion 23 of the housing 21, and when the electric wire pressing protrusion 31 enters the corresponding terminal receiving chamber 30 and presses an electric wire, a press-fitting terminal and the electric wire are electrically contacted with each other. A locking arm 32 and a nipping wall portion 33 are set up in a state in which they are coupled by a coupling wall portion 34 at each of the right and left ends of the cover 22.

FIG. 4 shows one end of the cover 22. The locking arm 32 is set up from the outer end portion of the bottom wall portion 28 of the cover 22, and the coupling wall portion 34 is integrally formed by bending one end of the locking arm 32 in the longitudinal direction perpendicularly. The nipping wall portion 33 is integrally formed by further bending the end of the coupling wall portion 34 perpendicularly. The nipping wall portion 33 and the locking arm 32 are parallel to each other with an insertion clearance gap 35 between them, and the standing wall portion 26 of the housing 21 is inserted into the insertion clearance gap 35. By the above insertion, the locking arm 32 is located on the outer surface side of the standing wall portion 26 while the nipping wall portion 33 is located on the inner surface side of the standing wall portion 26, that is, the standing wall portion 26 is held between the locking arm 32 and the nipping wall portion 33.

In this embodiment, the coupling wall portion 34 and the nipping wall portion 33 are substantially as high as the locking arm 32 and hereby, the coupling wall portion 34 and the nipping wall portion 33 are as strong as the locking arm 32. Reference numeral 36 designates a locking hole which is through in the direction of the thickness of the locking arm 32, and the locking protrusion 27 of the housing 21 is fitted into it.

Locking arms 37 each having a locking hole 38 are set up at the right and left ends of the housing 21 as shown in FIGS. 1 and 2, like the locking arms 32 of the cover 22. The locking arms 37 are used in case another housing is further assembled on the housing 21, to thereby provide a press-fitting connector in which multiple housings are assembled.

In such an embodiment, as shown in FIG. 5, an electric wire 39 is inserted into the terminal receiving chamber 30 of the cover 22 so that the electric wire is opposite to the press-fitting portion of a press-fitting terminal (not shown) arranged in the terminal receiving chamber 30, and in this state, the cover 22 is pressed upon the housing 21. As a result, the electric wire 39 and the press-fitting terminal are electrically contacted with each other, and the locking protrusions 27 of the housing 21 are fitted into the locking holes 36 of the locking arms 32 respectively, so that the housing 21 and the cover 22 are assembled together.

In the above assembled state, the locking arm 32 and the nipping wall portion 33 coupled by the coupling wall portion 34 hold the standing wall portion 26 of the housing 21 from both its sides. In this state, even if tension caused by bending operates upon the electric wire 39, and the housing 21 and the cover 22 are deformed, the locking arm 32 and the nipping wall portion 33 coupled by the coupling wall portion 34 are deformed according to the above deformation, and the locking arm 32 and the nipping wall portion 33 are not separated from each other. Therefore, the degree of fitting between the locking arm 32 and the locking protrusion 27 is not decreased, and fitting between the locking arm 32 and the locking protrusion 27 is kept.

Further, in this embodiment, since the nipping wall portion 33 and the coupling wall portion 34 are as high as the locking arm 32, they are not only as strong as the locking arm 32 but coupling strength between the nipping wall portion 33 and the locking arm 32 via the coupling wall portion 34 is increased. Therefore, even if the housing 21 and the cover 22 are deformed, the quantity of the following deformation of the nipping wall portion 33, the coupling wall portion 34 and the locking arm 32 is not only small, but since the nipping wall portion 33 and the locking arm 32 can be integrally deformed accordingly, the degree of fitting between the locking arm 32 and the locking protrusion 27 is not decreased, and the fitting between them is maintained. Further, since the locking protrusion 27 is fitted into the locking hole 36 of the locking arm 32, strong fitting is achieved.

Figure 6:
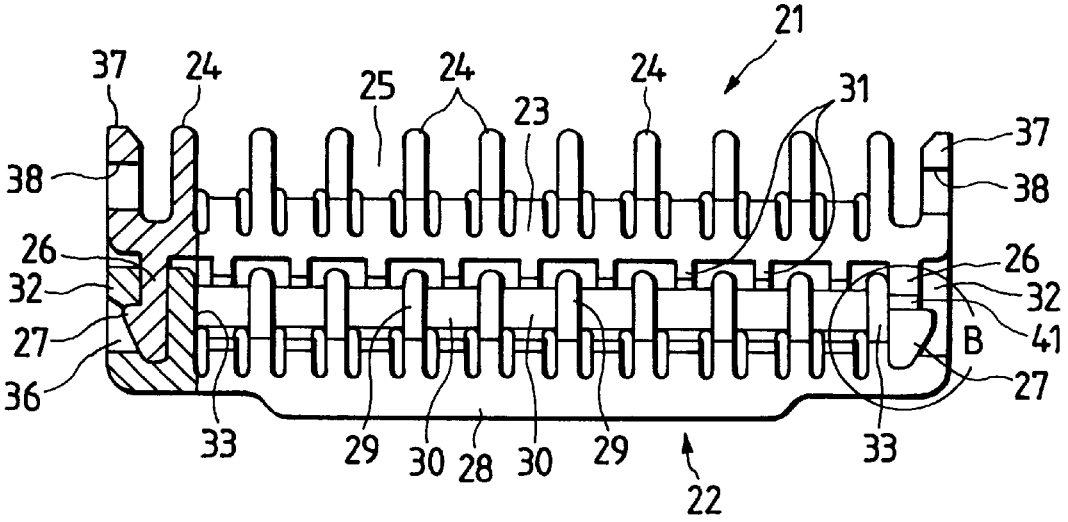
FIG. 6 is a partial front sectional view showing another embodiment.
Figure 7:
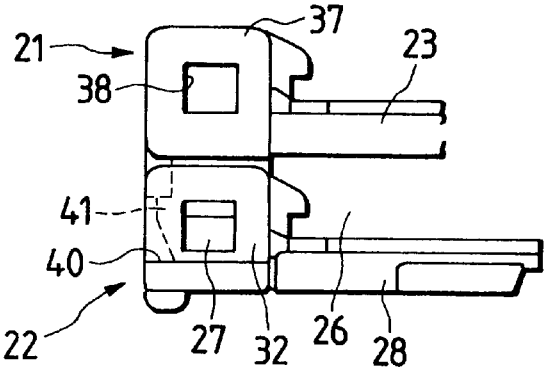
FIG. 7 is a right side view showing the another embodiment.
Figure 8:
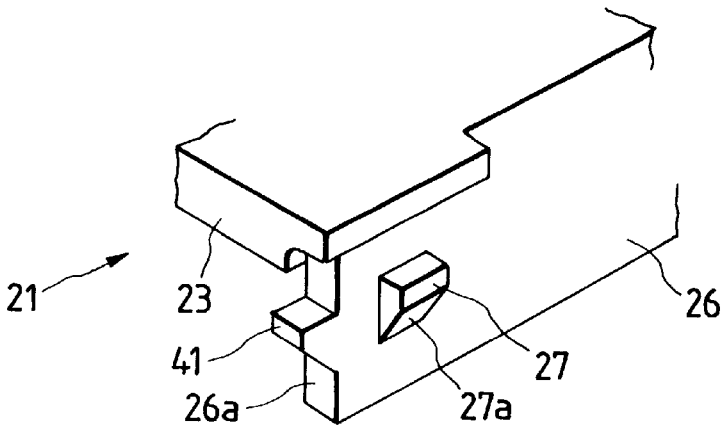
FIG. 8 is a partial perspective view showing a housing in the another embodiment.
Figure 9:
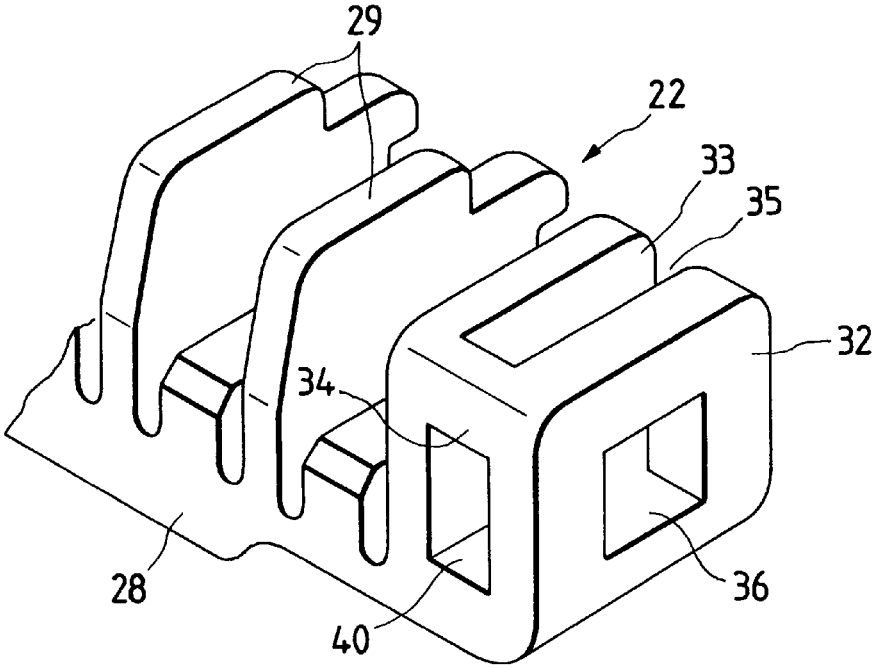
FIG. 9 is a partial perspective view showing a cover in the another embodiment.
Figure 10:
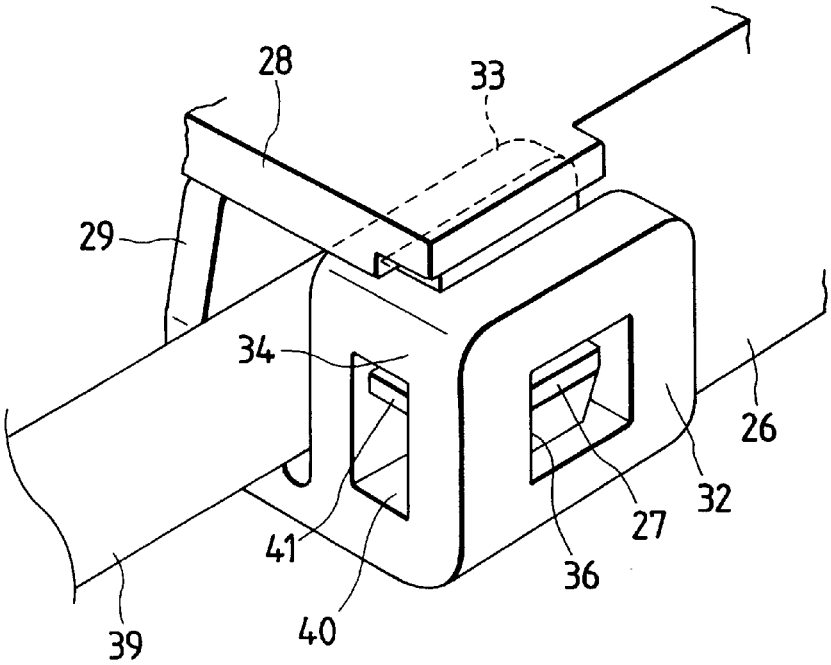
FIG. 10 is a perspective view in which a part B shown in FIG. 6 is enlarged for explaining the operation of the another embodiment.

FIGS. 6 to 10 show another embodiment of the present invention, FIG. 6 is a partial front sectional view, FIG. 7 is a side view thereof, FIG. 8 is a perspective view showing a part of a housing, FIG. 9 is a perspective view showing a part of a cover, and FIG. 10 is a perspective view in which a part B shown in FIG. 6 is enlarged for explaining the operation.

In this embodiment, the same reference numerals are allocated to the same components as in the above embodiment. In a cover 22, a locking arm 32 and a nipping wall portion 33 are coupled by a coupling wall portion 34, and a standing wall portion 26 of a housing 21 is held between the locking arm 32 and the nipping wall portion 33.

In this embodiment, in addition to the above structure, a fitting hole 40 is formed through the coupling wall portion 34, and a fitting protrusion 41 to be fitted into the fitting hole 40 is formed on the standing wall portion 26.

The fitting hole 40 is formed in the substantially central portion of the coupling wall portion 34 for coupling the locking arm 32 and the nipping wall portion 33 as shown in FIG. 9 so that the fitting hole is through the coupling wall portion 34 in the direction of the thickness thereof. Therefore, the fitting hole 40 is arranged in a position in which it is perpendicular to the locking hole 36 of the locking arm 32. On the other hand, the fitting protrusion 41 is formed on the end face 26*a* of the standing wall portion 26 with which the coupling wall portion 34 is to be in contact as shown in FIG. 8, and is fitted into the fitting hole 40 in this position. As a result, the fitting hole 40 and the fitting protrusion 41 are fitted together in the direction perpendicular to the position of fitting between the locking protrusion 27 and the locking arm 32.

FIGS. 7 and 10 show an assembled state in this embodiment. Since the standing wall portion 26 of the housing 21 is held between the locking arm 32 and the nipping wall portion 33 of the cover 22 coupled by the coupling wall portion 34, fitting between the locking protrusion 27 and the locking arm 32 is kept as in the above embodiment even if the housing 21 and the cover 22 are deformed.

Further, since the fitting hole 40 of the coupling wall portion 34 and the fitting protrusion 41 on the end face 26*a* of the standing wall portion 26 are fitted together in the direction different from the direction of fitting between the locking protrusion 27 and the locking arm 32, the deformation of the housing 21 and the cover 22 in the direction of the locking protrusion 27 does not operate upon fitting between the fitting hole 40 and the fitting protrusion 41. Therefore, the degree of fitting between the fitting hole and the fitting protrusion is not decreased, and fitting between them is maintained. Therefore, the assembly of the housing 21 and the cover 22 is further stabilized and ensured.

In the above embodiments, assembly in case a first connecting member is a housing and a second connecting member is a cover is described, however, the present invention can be also applied to a case when a plurality of housings such as a lower housing and an upper housing are assembled.

According to the present invention, since in the assembly of a first connecting member and a second connecting member, a nipping wall portion and a locking arm coupled by a coupling wall portion of the second connecting member hold a standing wall portion of the first connecting member and support the standing wall portion from its both sides, the locking arm and the nipping wall portion follow deformation described below, holding the standing wall portion between them even if the first connecting member and the second connecting member are deformed. Since the coupling wall portion couples the locking arm and the nipping wall portion at this time, the locking arm and the nipping wall portion are not separated from each other, and the degree of fitting between the locking arm and the locking protrusion is not decreased. Therefore, fitting between the locking arm and the locking protrusion is maintained.

What is claimed is:

1. An assembling structure of a press-fitting connector, comprising:

a first connecting member having partition portions and a bottom wall portion forming a terminal receiving chamber and a standing wall portion on one surface of which a locking protrusion is formed, said bottom wall portion being perpendicular to said standing wall portion;

a second connecting member having a locking arm to be fitted to the locking protrusion and to be attached to said first connecting member, and said second connecting member having a bottom portion from which said locking arm extends perpendicularly; and a nipping wall portion coupled to the locking arm by a coupling wall portion so that said nipping wall portion is opposite to the other surface of the standing wall portion and for nipping the standing wall portion in cooperation with the locking arm, wherein said coupling wall portions are perpendicular to said bottom wall portion of said first connecting member and said bottom portion of said second connecting member.

2. An assembling structure of a press-fitting connector, comprising:

a first connector member having partition portions forming a terminal receiving chamber and a standing wall portion on one surface of which a locking protrusion is formed;

a second connecting member having a locking arm to be fitted to the locking protrusion and to be attached to said first connecting member; and a nipping wall portion coupled to the locking arm by a coupling wall portion so that said nipping wall portion is opposite to the other surface of the standing wall portion and for nipping the standing wall portion in cooperation with the locking arm, wherein a fitting hole is formed in the coupling wall portion, and a fitting protrusion to be fitted into the fitting hole is formed in the standing wall portion.

3. The assembling structure according to claim 1, wherein the nipping wall portion and the coupling wall portion are substantially as high as the locking arm.

4. The assembling structure according to claim 1, wherein the locking arm has a locking hole, and the locking hole and the locking protrusion are fitted together.

5. The assembling structure according to claim 1, wherein said first connecting member is a housing, and said second connecting member is a cover.

6. An assembling structure of a press-fitted connector, comprising:

a first connector member having a bottom wall portion and a standing wall portion on one surface of which a locking protrusion is formed, said bottom wall portion being perpendicular to said standing wall portion;

a second connecting member having partition walls forming a terminal receiving chamber and a locking arm to be fitted to the locking protrusion and to be attached to said first connecting member, and a bottom portion from which said locking arm extends perpendicularly; and a nipping wall portion coupled to the locking arm by a coupling wall portion so that said nipping wall portion is opposite to the other surface of the standing wall portion and for nipping the standing wall portion in cooperation with the locking arm, said coupling wall portion is perpendiular to said bottom wall portion and said bottom portion wherein said first connecting member has partition walls forming a terminal receiving chamber and a locking arm so that terminal receiving chambers are formed in both the first and second connecting members, so that each of the first and second connecting members are housings and said first connecting member is additionally a cover for said second connecting member.

* * * * *

UNITED STATES PATENT AND TRADEMARK OFFICE

CERTIFICATE OF CORRECTION

PATENT NO. : 5,957,719

DATED : 9/28/1999

INVENTOR(S) : OKABE

It is certified that error appears in the above-identified patent and that said Letters Patent is hereby corrected as shown below:

Column 6, line 8, delete "portions are" and insert --portion is--

Column 6, line 56, after "said bottom portion", insert --,--

Signed and Sealed this

Seventh Day of November, 2000

*Attest:*

Q. TODD DICKINSON

*Attesting Officer*

*Director of Patents and Trademarks*